United States Patent [19]

Chuang

[11] Patent Number: 4,507,704

[45] Date of Patent: Mar. 26, 1985

[54] CIGARETTE BOX WITH SELF-LIGHTING DEVICE AND LIGHTER

[76] Inventor: Yung-Ho Chuang, 2nd Fl. No. 38, La. 45, Cheng-Yi S. Rd. Sanchung, Sanchung, Taiwan

[21] Appl. No.: 560,967

[22] Filed: Dec. 13, 1983

[51] Int. Cl.[3] ..... F23Q 7/00

[52] U.S. Cl. ..... 361/264; 206/85

[58] Field of Search ..... 361/264; 206/85, 86

[56] References Cited

U.S. PATENT DOCUMENTS

| | | | |
|---|---|---|---|
| 1,656,785 | 1/1928 | Foster | 206/86 |
| 2,006,591 | 7/1935 | Fox | 206/85 |
| 2,235,335 | 3/1941 | Schmitt | 206/85 |
| 2,301,775 | 11/1942 | Goettie | 206/85 X |
| 2,991,875 | 7/1961 | Zarrello | 206/85 |

FOREIGN PATENT DOCUMENTS

| | | | |
|---|---|---|---|
| 693581 | 7/1940 | Fed. Rep. of Germany | 206/85 |

*Primary Examiner*—Donald A. Griffin

*Attorney, Agent, or Firm*—Holman & Stern

[57] ABSTRACT

A cigarette box with self-lighting device and spare lighter is comprised of a main box and a spare box. The main box is in "L" shape, with a pivoted main box cover plate which has a view window and a retaining plate chute and can be optionally opened, closed and fixed. One side of the interior of the main box has a cigarette self-lighting device, and the other side has a spare cigarette lighting device. Ten cigarettes may be stored in the main box. The spare cigarette box is dish shaped and is pivoted to the main box cover plate at the outside. A mobile wave-shape cover plate is pivoted to the front of the spare box for storing 10 cigarettes. A lighted cigarette will be ready for the user with a light touch on the self-lighting button.

6 Claims, 5 Drawing Figures

CIGARETTE BOX WITH SELF-LIGHTING DEVICE AND LIGHTER

SUMMARY OF THE INVENTION

The cigarette box with self-lighting device and spare lighter of this invention comprises a convenient device to provide a lighted cigarette for smoking by merely pressing a self-lighting button. The present invention can be held by hand, or placed on the gable, for use by pressing gently the self-lighting button to light a cigarette stored in a special container, or provide the lighting operation for a separate cigarette, so as to take the place of a match or separate lighter.

BRIEF DESCRIPTION OF THE DRAWINGS

The invention will now be described in detail with reference to the accompanying drawings wherein.

DETAILED DESCRIPTION OF THE INVENTION

Figure 1:
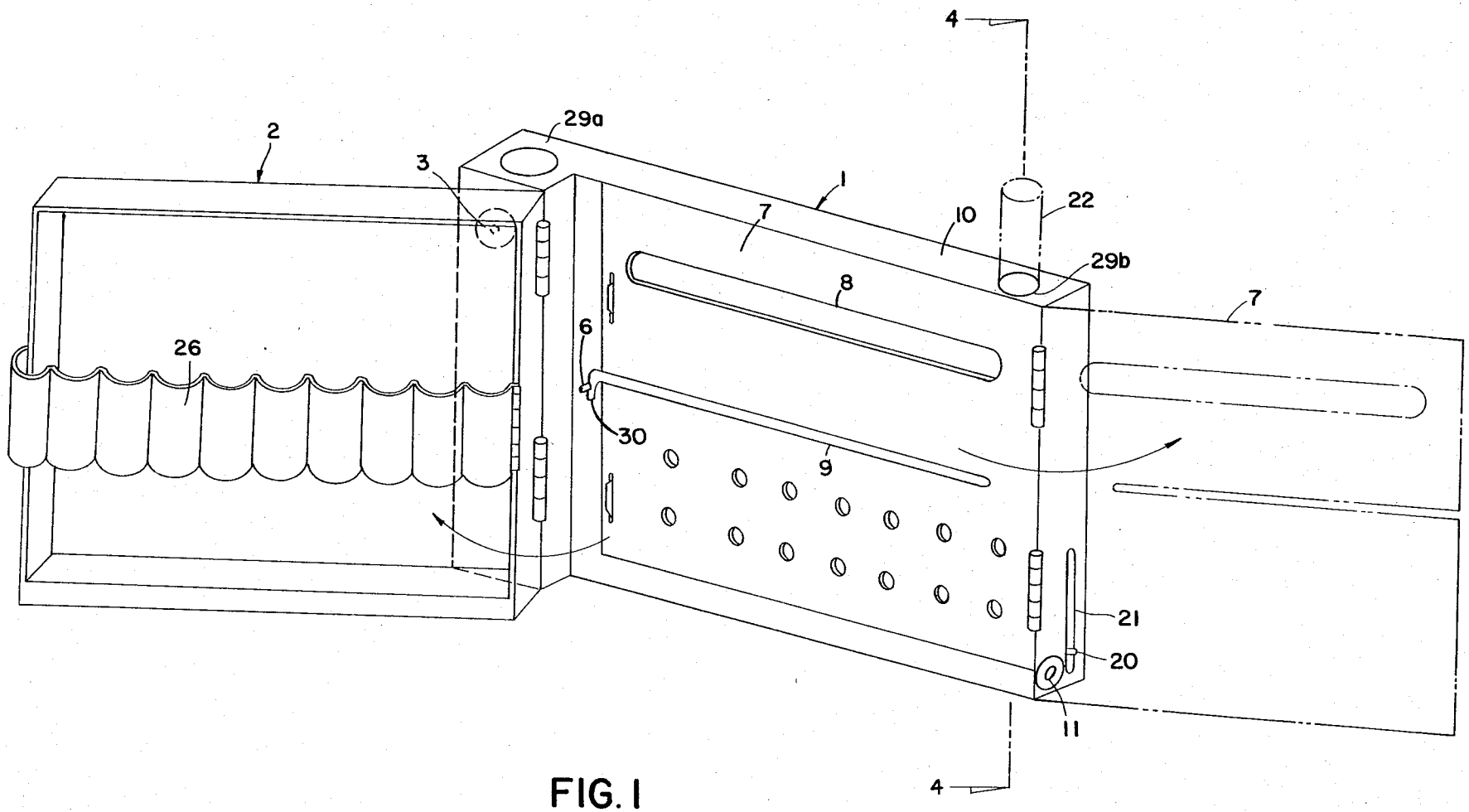
FIG. 1 is a perspective view of the invention in the open position.
Figure 2:
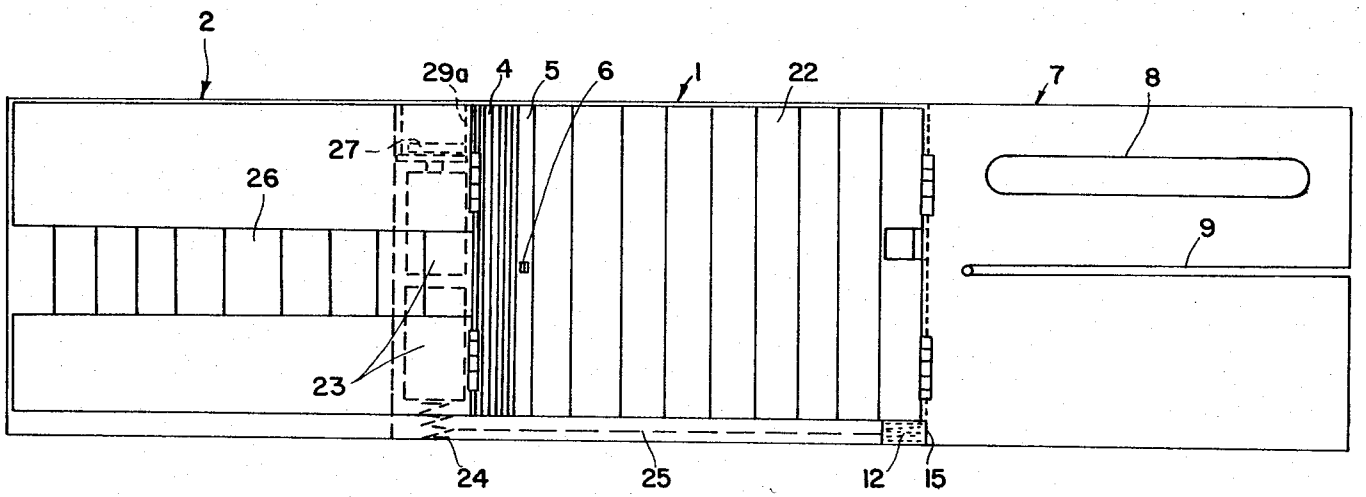
FIG. 2 is a front elevational view of the invention in the open position.

Referring to FIG. 1 & FIG. 2, the present invention comprises two parts: the main box in "L" shape joined by a pivot to spare box 2, whereby it can be opened or closed, having a cover 7 with a view window 8, and retaining element chute or slot 9. The main box 1 can hold ten or less cigarettes 22 in it.

The internal part at one side (right) of the main box 1 is provided with a self-lighting device comprising self-lighting button 11, electric heating wire 14, lighting device 15, lighting device spring 12, fixing spring 13, slide rest 16, guides 17, upper and bottom magnetic points 18*a*, 18*b*, fixing device 19, pull rod 20, and two cigarette holders 28.

Figure 5:
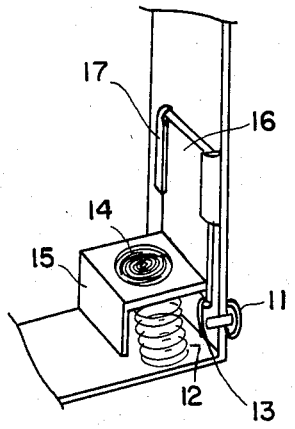
FIG. 5 is a perspective cross-sectional view of the lighting device shown in FIG. 4.
Figure 4:
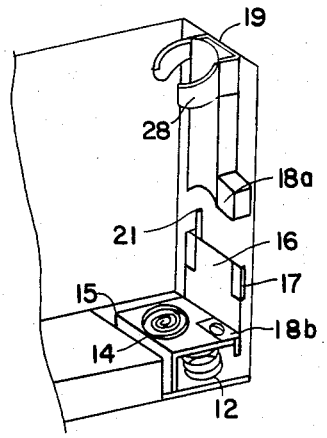
FIG. 4 is a cross-sectional view taken along line 4—4 of FIG. 1.

Referring to FIGS. 4 & 5, the self-lighting device comprises the lighting device 15 which is a "U" shaped body having the electric wire 14 for lighting the cigarette, the lighting device spring 12 at its inside, and slide rest 16 with a hem at its side or its bottom end. The main box 1 is provided with a set of guides 17 at its right side, in order to guide the said slide rest 16, the back of which is provided with pull rod 20. The right side of the main box 1 has aligned with pull rod 20 a long pull rod chute, or slot, 21 at the position opposite to the hem at the lowest position where the slide rest 16 goes down. The right side of the main box 1 is provided with the lighting button 11 and a fixing spring 13. If the pull rod 20 at the right side of the main box 1 is moved along the chute 21 downwardly the slide rest 16 is moved with the lighting device 15 downwardly along the guides 17, then stops at the hem below the slide rest 16 and is located by fixing spring 13. In this position the self-lighting device will not work. If the user wants to light a cigarette, he releases the fixing spring 13 from the lower hem of slide rest 16 by pressing gently the lighting button 11, and the slide rest 16 moves with the lighting device 15 upward along the guides 17, and then electric heating wire 14 of the lighting device 15 will send a cigarette 22 through the self-lighting hole 29*b* (as shown in FIG. 1). At this time, two upper and lower magnetic points 18*a*, 18*b* at one side of the slide rest will contact each other, whereby the electric heating wire 14 is supplied with power so as to light the cigarette 22 which will be held by two cigarette holders 28 for use. Then the user pulls down the pull rod 20 so that the upper and lower magnetic points 18*a*, 18*b* separate from each other, the electric wire 14 is de-energized, and the slide rest 16 and lighting device go along two guides 17 downwardly and are locked by fixing spring 13 for the next cigarette lighting.

The other side (left) of the main box 1 is provided with the spare lighting device comprising lighting button 3, lighting electric wire 27, connecting point spring 24, two dry cells 23 and a spare lighting hole 29*a*. The spare lighting hole 29*a* is provided through the upper cover 10 of the main box at the protruding left side part of the main box 1. The spare lighting electric heating wire 27 is provided at the inside bottom of lighting hole 29*a* where the cigarette can be inserted. The spare lighting electric heating wire 27 is supplied with power and lights the cigarette by pressing the spare lighting button 3. This cigarette to be lighted can come from the spare box 2 or from other than the holders of the present invention. The said self-lighting hole 29*b* is provided at the other (right) side of the cover 10 of the main box, opposite to the upper position of the spare lighting device. The spare lighting button 3 is provided as the switch which is at the proper place of one side of spare lighting hole 29*a* and connected with the wire, dry cell 23 (positive) and the spare lighting electric heating wire 27. As soon as the button is pressed, the spare lighting electric heating wire 27 is supplied with power and the cigarette is lighted accordingly; when it is released, the power is cut and the lighting device will not work. The two series cells 23 are provided in the protruding body part at the left side of the main box 1 on the lower side of spare lighting electric heating wire 27. A movable cover is provided at one side in order to allow replacement of the dry cells. The wire connecting spring 24 is provided at the lower end of the dry cell 23 so as to supply the power to the box body of the present invention (made of aluminum alloy or other like metal plate). An insulation washer is provided at its upper end and the power-conducting tap is provided at its inside in order to connect the guide wire and the spare lighting button. The power guide wire 25 is inserted into the lower side of the main box 1 and connected to the self-lighting button 11 of the self-lighting device in series to serve as the power source of that device. A No. 3, 1.5 V cell can be used for 5 packets of cigaretts (100 pieces).

Figure 3:
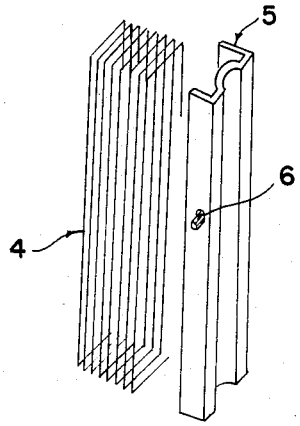
FIG. 3 is a perspective view of the pushing spring and cigarette pushing plate of the invention.

Referring to FIGS. 2 & 3, an oblong or similar spring 4 and a punched cigarette pushing plate 5 having an "M" cross-sectional shape are provided at the protruding part of the lower side of the spare lighting hole 29*a* and the main box 1. A protruding retaining element 6 is provided at one side of the plate 5, (outside) opposite to the retaining element chute 9 on the main box cover plate 7. The pushing plate 5 can fix itself at the left side of the main box 1 by engaging the retaining element 6 at the one side of the plate in L-shaped or off-set slot, or locating hole 30, in main box 1 at the end of chute 9, which locates and stores the spring force of the pushing spring 4. As soon as the retaining element 6 is released from locating hole 30, the cigarette pushing plate 5 is pushed, under the spring 4 force, forward from the left side and along the retaining plate chute 9 on the main box cover plate 7 to push the ten cigarettes 22 in the main box 1 to the self-lighting device for use until the last one. Then the cigarette pushing plate 5 is pushed back along the retaining plate chute 9 and locked in retaining locating hole 30. Then the main box cover plate 7 is opened in order to reload 10 cigarettes into the main box for re-lighting.

The spare box 2 is fixed and joined firmly to the main box outside of the main box cover 7. The thickness of the two units is flush with the thickness of the protruding part of the body at the left side of the main box 1. This spare box 2 is in "U" shape, and a spare box cover plate 26 in corrugated shape which can be opened or closed freely is attached by a pivot on the front of the spare box 2 in order to hold each spare cigarette and prevent it from moving left and right when the spare box 2 is loaded with 10 spare cigarettes or less cigarettes.

Due to its two devices of self-lighting and spare lighting, the present invention can be used alternatively and conveniently; when pressing the self-lighting button, the lighted cigarette will appear automatically until the box is empty. When this occurs the cigarettes in the spare box can be conveyed into the main box so as to light the cigarette in the aforesaid manner conveniently. In addition, the present invention can be held by hand or placed on the table, and a cigarette other than one stored in the main box, or one from the spare box, can be lighted by pressing gently the spare lighting button. The additional advantage of the present invention is that it can take the place of a match or lighter. Thus the present invention is outstanding, unique, convenient and practical.

What is claimed is:

1. A cigarette box with a self-lighting device comprising:

a main box member having a hollow space therein for storing a plurality of cigarettes;

an electrical resistance type cigarette lighter positioned at one end of said hollow space to receive in abutting contacting relationship one end of a cigarette;

an automatic feeding means extending from the other end of said hollow space for urging said cigarettes toward and into contacting relationship with said cigarette lighter;

an electric power source to provide electric power to said lighter;

means to activate said lighter to light a cigarette in contact therewith;

an aperture through said main box member substantially opposite said lighter through which said lighted cigarette is removable; and a cover pivotally mounted on said main box member for covering said hollow space.

2. A cigarette box as claimed in claim 1 wherein said lighter comprises:

a U-shaped member slidably mounted on the side of said main box member at said one end;

an electrical resistance element mounted on said U-shaped member;

a lighter spring member operably mounted between said main box member and said U-shaped member to resiliently urge said U-shaped member toward said aperture;

a retaining spring operably engageable with said U-shaped member to releasably retain said U-shaped member in the inactivated position against the force of said lighter spring member;

a release button operably mounted on said main box member and engageable with said retaining spring to release said retaining spring when depressed so that said lighter spring member moves said U-shaped member and a cigarette in contact therewith toward said aperture into lighting position with part of the cigarette extending through said aperture;

means to connect said electrical resistance element to said power source when in said lighting position to energize said element to light a cigarette in contact therewith; and means on said U-shaped member to manually return said U-shaped member to the inactivated position against the force of said lighter spring member.

3. A cigarette lighter as claimed in claim 2 wherein said feeding means comprises:

a pusher member slidably mounted in said hollow space operably engageable with at least one cigarette;

a feeding spring operably mounted between said pusher member and the wall of said main box member at the other end of said hollow space remote from said lighter to resiliently urge said pusher member and any cigarettes between said pusher member and said lighter at said one end of the hollow space toward said lighter; and releasable pusher retaining means to selectively retain said pusher member in retracted position adjacent said other end of the hollow space against the force of said feeding spring.

4. A cigarette box as claimed in claim 3 and further comprising:

a retaining member protruding from the outer side of said pusher member facing said cover;

an elongated slot in said cover open at the end thereof opposite said pivotal mounting for said cover to slidably receive therein said protruding retaining member; and wherein said pusher retaining means comprises a substantially L-shaped slot in said other end of said main box having one leg aligned with and open to said slot in said cover when said cover is closed and the other leg off-set therefrom to receive and retain said protruding retainer on said pusher member.

5. A cigarette box with a self-lighting device comprising:

a main box having an L-shape formed by a protruding portion at one end;

a hollow portion between said protruding portion and the other end of the main box to receive a plurality of cigarettes in substantially parallel alignment;

a cover plate pivotally connected to said other end of the main box to cover said hollow portion when closed;

a view window in said cover plate;

an elongated slot on said cover plate open at the end adjacent said protruding portion when closed;

a spare cigarette lighter in said protruding portion;

a spare cigarette box having a channel-shaped cross-section for receiving a plurality of cigarettes pivotally connected at one end to said protruding portion to overlie said cover plate in the closed position;

a corrugated spare cigarette cover plate pivotally connected at one end of said spare cigarette box so that it can be opened for inserting cigarettes into said spare box and closed to retain cigarettes therein, the corrugations being sized and adapted to individually engage said spare cigarette to substantially prevent movement thereof;

a U-shaped member within said hollow portion at the other end of said main box;

an electric heating wire for lighting a cigarette mounted in said U-shaped member;

a slide member connected to said U-shaped member and slidably mounted in guides mounted on said main box;

a hem at the lower end of said slide member;

a pull rod protruding from said slide member;

an elongated slot at said other end of said main box in which said pull rod slidingly engages so that said slide and U-shaped member can be manually moved between non-lighting and lighting positions;

a lighter spring between said U-shaped member and said main box to resiliently urge said U-shaped member and slide member toward the lighting position;

a retaining spring mounted on said main box and releasably engageable with said hem to retain said slide and U-shaped members in the non-lighting position against the force of said lighter spring;

a lighting button mounted in said main box to be engageable with said retaining spring to release said retaining spring from said slide member so that said U-shaped member and slide member are moved by said lighter spring into the lighting position;

a hole through said main box aligned with and opposite to said U-shaped member so that a cigarette in contacting engagement at one end with said electric heating wire is partially fed through said hole in the lighting position;

an electric power source mounted in said main box;

a pair of magnets on said U-shaped member and said main box arranged to contact each other in the lighting position to connect said electric heating wire to said power source to light a cigarette in contact with said wire; and a pair of holders mounted on said main box to releasably hold a cigarette in the lighting position.

6. A cigarette box with a self-lighting device comprising:

a main box having an L-shaped formed by a protruding portion at one end;

a hollow portion between said protruding portion and the other end of the main box to receive a plurality of cigarettes in substantially parallel alignment;

a cover plate pivotably connected to said other end of the main box to cover said hollow portion when closed;

a view window in said cover plate;

an elongated slot in said cover plate open at the end adjacent said protruding portion when closed;

a spare cigarette lighter in said protruding portion;

a spare cigarette box having a channel-shaped cross-section for receiving a plurality of cigarettes pivotally connected at one end to said protruding portion to overlie said cover plate in the closed position;

a corrugated spare cigarette cover plate pivotably connected at one end to said spare cigarette box so that it can be opened for inserting cigarettes into said spare box and closed to retain cigarettes therein, the corrugations being sized and adapted to individually engage said spare cigarette to substantially prevent movement thereof;

a hole through said protruding portion of the main box for insertion of the end of a cigarette into engagement with said spare cigarette lighter;

an oblong pushing plate having a substantially M-shaped cross-section slidably mounted in said hollow portion for pushing cigarettes in said hollow portion toward said other end;

an oblong pusher spring mounted in said hollow portion between said protruding portion of the main box and said pushing plate to resiliently urge said pushing plate and any cigarettes in the hollow portion toward said other end;

a retaining member protruding from the outer side of said pushing plate engageable in sliding relationship in said elongated slot in said cover plate;

a retaining slot in said one end of the main box communicating with said open end of said slot in said cover plate when closed and adapted to receive and releasably hold said retaining member therein against the force of said pusher spring;

a self-lighting device in said hollow portion at the other end of said main box positioned to receive in contacting engagement therewith one end of a cigarette pushed by said pushing member when in the released position; and means to activate said self-lighting device to light a cigarette in contact therewith.

* * * * *